US008243885B2

(12) United States Patent
Kawasaki et al.

(10) Patent No.: US 8,243,885 B2
(45) Date of Patent: Aug. 14, 2012

(54) X-RAY GENERATOR

(75) Inventors: Katsumi Kawasaki, Yokohama (JP); Yutaka Inari, Yokohama (JP); Hiroshi Chiba, Yokohama (JP)

(73) Assignee: Bruker AXS K.K., Yokohama (JP)

( * ) Notice: Subject to any disclaimer, the term of this patent is extended or adjusted under 35 U.S.C. 154(b) by 351 days.

(21) Appl. No.: 12/318,413

(22) Filed: Dec. 29, 2008

(65) Prior Publication Data

US 2009/0175420 A1 Jul. 9, 2009

(30) Foreign Application Priority Data

Dec. 27, 2007 (JP) ..... 2007-336450

(51) Int. Cl.
*H01J 35/10* (2006.01)

(52) U.S. Cl. ..... 378/144; 378/125

(58) Field of Classification Search ..... 378/125, 378/127, 128, 130, 132, 144
See application file for complete search history.

(56) References Cited

U.S. PATENT DOCUMENTS

| | | | | |
|---|---|---|---|---|
| 5,410,390 | A * | 4/1995 | Miura et al. | 399/303 |
| 5,414,501 | A * | 5/1995 | Miura et al. | 399/298 |
| 7,005,774 | B2 * | 2/2006 | Kuribayashi et al. | 310/244 |
| 2002/0146092 | A1 * | 10/2002 | Richardson et al. | 378/130 |
| 2005/0280329 | A1 | 12/2005 | Day et al. | |
| 2006/0013364 | A1 | 1/2006 | Sakata et al. | |
| 2008/0258576 | A1 * | 10/2008 | Oh et al. | 310/249 |
| 2009/0045694 | A1 * | 2/2009 | Oh et al. | 310/251 |
| 2010/0252420 | A1 * | 10/2010 | Barnard et al. | 204/194 |

FOREIGN PATENT DOCUMENTS

| | | |
|---|---|---|
| CN | 200 941 706 Y | 8/2007 |
| EP | 1 524 737 A1 | 4/2005 |
| JP | A-07-192665 | 7/1995 |
| JP | A-08-106870 | 4/1996 |

* cited by examiner

*Primary Examiner* — Hoon Song
*Assistant Examiner* — Mona M Sanei
(74) *Attorney, Agent, or Firm* — Oliff & Berridge, PLC

(57) ABSTRACT

To provide an X-ray generator capable of preventing electric corrosion and exerting stable performance over long periods. The X-ray generator includes: a rotary anticathode having a rotary anticathode part and a shaft part; an anticathode accommodating case including an air-tight case part for keeping an area surrounding the rotary anticathode part in a vacuum atmosphere, and a journaling case part for rotatively supporting the shaft part via a bearing; and an electric motor to rotatably drive the anticathode (target). A water-cooled jacket, through which cooling water for cooling the rotary anticathode part and the shaft part flows, is provided in the rotary anticathode. In the X-ray generator, an insulating bearing of which at least one of an inner ring, an outer ring and a rolling element is made of an insulating material is used as the bearing, and a conductive fiber brush having a large number of conductive microfibers serving as slide-contacting brush is arranged between opposing peripheral surfaces of the journaling case part of the anticathode accommodating case and the shaft part of the rotary anticathode, such that current is flown from the rotary anticathode to the anticathode accommodating case via the conductive fiber brush. In addition, pure water or ion-exchange water having low electric conductivity is used as cooling water flown through the water-cooled jacket.

11 Claims, 4 Drawing Sheets

X-RAY GENERATOR

BACKGROUND OF THE INVENTION

Background

1. Field of the Invention

The present invention relates to an X-ray generator of a rotary anticathode type, and particularly to an X-ray generator which can eliminate a negative impact of electric corrosion.

2. Description of the Related Art

FIG. 5 shows an X-ray generator of a rotary anticathode type disclosed in Japanese Patent Application Laid-Open No. 7-192665.

In the figure, designation numeral 1 indicates a rotary anticathode, designation numeral 2 indicates an anticathode accommodating case, and designation numeral 3 indicates an electric motor. The rotary anticathode 1 has a hollow anticathode part 1*a* for generating an X-ray 5 from an anticathode surface 1 *c*, which is parallel to a rotating shaft, by collision of thermoelectrons e emitted from an electron gun 4, and a hollow cylindrical shaft part 1*b* that continues from this anticathode part 1 *a*. Then, a water-cooled jacket 7 is formed by a partitioning member 6 which is formed into a cylindrical shape concentric with this rotary anticathode 1. In this water-cooled jacket 7, a space between the partitioning member 6 and the rotary anticathode 1 is set as a refrigerant feed path 7*a*, and an inside of the partitioning member 6 is set as a refrigerant discharge path 7*b*, and the refrigerant is flown through this water-cooled jacket 7 as shown by arrow.

The anticathode accommodating case 2 includes an air-tight case part 2*a* and a journalng case part 2*b*. The air-tight case part 2*a* keeps an area surrounding the rotary anticathode part 1*a* and the electron gun 4 in a vacuum atmosphere. The journaling case part 2*b* rotatably supports the rotary anticathode 1 via a bearing 8 fitted onto the shaft part 1*b*. As illustrated in the figure, the air-tight case part 2*a* is equipped, at a predetermined position, with an X-ray transmissive window 2*e* which transmits a line-shaped X-ray 5 emitted from the rotary anticathode part 1*a*. A rear end portion (right end portion in FIG. 5) of the journaling case part 2*b* is connected to the end portion of a partitioning member 7 in a liquid-tight manner. Further, as illustrated in the figure, a refrigerant feeding port 2*d*for communicating with the refrigerant feed path 7*a* is provided at a position closer to the rear end portion of the journaling case part 2*b*.

The electric motor 3 drives by rotating the rotary anticathode 1. The electric motor 3 is configured such that: a rotor 3*a* serving as an outputting portion of torque is fixed to the vicinity of the outer peripheral portion of the rotary anticathode part 1*a;* a coil portion 3*b* for rotating the rotor 3*a* is fixed to an annular portion 2*c* provided projecting from the journaling case part 2*b*, and the rotor 3*a* is arranged so as to surround the outer periphery of the coil portion 3*b*. Note that, in FIG. 3, Reference Numeral 9*a* denotes an air-tight seal (vacuum seal) for keeping the inside of the air-tight case part 2*a* in a vacuum state, and Reference Numeral 9*b* denotes a liquid-tight seal (water seal) which prevents the refrigerant from flowing into the bearing 8 side and the electric motor 3 side.

Incidentally, in an X-ray generator of a rotary anticathode type, since current (called as "tube current") flows in the rotary anticathode 1 in the form of an electron beam during the operation thereof, it is necessary to allow the current to escape from the rotating rotary anticathode 1 to the anticathode accommodating case 2 on the fixed side. In this case, when the current is flown from the rotary anticathode 1 to the anticathode accommodating case 2 via the steel bearing 8, an electric corrosion phenomenon occurs at a contact part between an rolling element (e.g., steel ball) and inner and outer rings (bearing rings) that constitute the bearing 8, which may lead to a breakdown.

In order to prevent the electric corrosion phenomenon, a brush unit is arranged between a rotating portion and a fixed portion, so as to cause current to flow from the rotating portion to the fixed portion via the brush unit. In addition, a ceramic bearing is used as an anti-electric corrosion bearing (for example, see Japanese Patent Application Laid-Open No. 8-106870).

However, the conventional brush unit is of a type which presses a contact piece to the outer periphery of a shaft part of a rotating body by means of pressure of a spring, which is likely to leads to a short service life due to wear. In the case where it becomes difficult for current to flow from the rotating portion to the fixed portion due to wear of the contact piece, even if use of a ceramic bearing has enabled the bearing itself to be immune to electric corrosion, oxides become likely to be generated due to electric corrosion in cooling water. The oxides can adhere to a portion such as a refrigerant passage portion (portion shown by Numeral P in FIG. 5) which has been designed narrower in order to enhance cooling efficiency. As a result, cooling efficiency decreases greatly, which may cause a phenomenon in which a surface of the rotary anticathode part la gets rough or melted.

In particular, recently, substantial enhancement in output and brightness of X-ray is requested. Since output and brightness of X-ray increases in association with circumferential velocity of the rotary anticathode, increase in the rotational speed of the rotary anticathode is needed. For example, while the rotational speed of a current rotary anticathode is 6000 to 9000 rpm, the rotational speed need be increased to 20000 to 30000 rpm in order to meet the request for enhancing output of X-ray. However, in the case where such increase in the rotational speed of the rotary anticathode is to be actualized, although the bearing, the seal and the like can be adequately addressed, it is found that the conventional brush unit without measures cannot stand the increased speed at all.

For example, when the shaft part having the shaft diameter 22 mm was rotated at 20000 rpm, and then a contact piece (carbon) of the conventional brush unit was pressed to the outer periphery of the shaft part, the amount of wear of the contact piece was 2.5 mm/1000 hours in an endurance test. It means that the service life of a contact piece with thickness of 5 mm ends at 2000 hours.

Furthermore, when wear becomes severe as described above, temperature will increase due to frictional heat and abrasion powders will be generated in a large amount, whereby a negative impact on the bearing, the seal, or the like in the vicinity of the brush unit will be increased greatly. Furthermore, the contact piece in contact with the shaft part has large frictional resistance in the conventional brush unit. Accordingly, when the rotational speed of the rotary anticathode is increased, rotational loss caused by frictional resistance of the brush unit will not be negligible, which impedes size reduction of the electric motor or the like.

SUMMARY OF THE INVENTION

In consideration of the foregoing circumstances, it is an object of the present invention to provide an X-ray generator enables eliminating a negative impact of electric corrosion as much as possible so as to increase durability, and resolving a negative impact of generated abrasion powders on a bearing, seal, or the like, and rotational loss caused by frictional resistance, so as to greatly increase the rotational speed of a rotary anticathode, and thereby to increase output of X-ray.

The invention according to First aspect of the present invention relates to an X-ray generator including: a rotary anticathode having an rotary anticathode part for generating an X-ray by means of collision of thermal electrons and a shaft part provided coaxially with the rotary anticathode part; an anticathode accommodating case including an air-tight case part for keeping an area surrounding the rotary anticathode part in a vacuum atmosphere, and a journaling case part for rotatively supporting the shaft part via a bearing; and an electric motor for driving by rotating the rotary anticathode, in which the rotary anticathode comprising therein a water-cooled jacket which causes cooling water for cooling the rotary anticathode part and the shaft part to flow. In the X-ray generator, an insulating bearing of which at least one of an inner ring, an outer ring and a rolling element is made of an insulating material is used as the bearing, and a conductive fiber brush having a large number of conductive microfibers serving as slide-contacting brush is arranged between the anticathode accommodating case and the rotary anticathode, such that current is flown from the rotary anticathode to the anticathode accommodating case via the conductive fiber brush.

The invention according to Second aspect of the present invention according to the first aspect relates to the X-ray generator, wherein the conductive fiber brush is arranged between a peripheral surface of the journaling case part of the anticathode accommodating case and a peripheral surface of the shaft part of the rotary anticathode, with both peripheral surfaces being opposed to each other.

The invention according to Third aspect of the present invention according to the second aspect relates to the X-ray generator, wherein the conductive fiber brush includes: a conductive ring fitted into an inner periphery of the journaling case part; and a large number of the conductive microfibers, each base end thereof being supported by an inner periphery of the conductive ring in a brush-like shape and each distal end thereof being in soft contact with an outer periphery of the shaft part of the rotary anticathode.

The invention according to Fourth aspect of the present invention according to the second aspect relates to the X-ray generator, wherein the conductive fiber brush includes: a conductive ring fitted into an outer periphery of the shaft part of the rotary anticathode; and a large number of the conductive microfibers, each base end thereof being supported by an outer periphery of the conductive ring in a brush-like shape and each distal end thereof being in soft contact with an inner periphery of the journaling case part.

The invention according to Fifth aspect of the present invention according to the second aspect relates to the X-ray generator, wherein the conductive fiber brush includes: a pair of conductive rings which are provided respectively on an outer periphery of the shaft part of the rotary anticathode and on an inner periphery of the journaling case part, with mutual end surfaces opposed to each other in the axial direction; and a large number of the conductive microfibers, each base end thereof being supported by the opposed end surface of one of the pair of conductive rings in a brush-like shape, and each distal end thereof being in soft contact with the opposed end surface of the other conductive ring.

The invention according to Sixth aspect of the present invention according to any one of the first to fifth aspects relates to the X-ray generator, pure water or ion-exchange water having low electric conductivity is used as cooling water flown through the water-cooled jacket.

According to the invention of the first aspect, the conductive fiber brush having a large number of the conductive microfibers serving as slide-contacting brush is arranged between the anticathode accommodating case and the rotary anticathode, such that current is flown from the rotary anticathode to the anticathode accommodating case via the conductive fiber brush of a conductive microfiber type. Accordingly, unlike the conventional case where a contact piece is made in slidable contact with the outer periphery of the shaft part by means of a force of a spring, the conductive microfibers serving as a slide-contacting brush can be brought into a slidable contact with a slidable surface on the counterpart side, in the state where substantially no pressure is applied thereto. Therefore, since no contact pressure is applied, the conductive microfibers are free from wear, and current in the rotary anticathode can escape to the anticathode accommodating case reliably over long periods. In addition, the insulating bearing is employed as the bearing for rotataively supporting the rotary anticathode. Therefore, let alone a problem of electric corrosion of the bearing, a problem of decreased cooling efficiency caused by oxides generated in cooling water because of electric corrosion can be effectively resolved.

In addition, the conductive microfibers of the conductive fiber brush are substantially free from wear, and there is no temperature increase due to frictional heat. Therefore, the conductive microfibers are compatible with the substantially increased rotational speed of the rotary anticathode, thereby to enable increasing output and brightness of X-ray. Furthermore, there is neither risk of temperature increase due to frictional heat, nor risk of generation of abrasion powders. Therefore, such a problem that temperature increase or generation of abrasion powders would negatively affect the bearing or seals will not occur. In addition, substantially no frictional resistance is generated between the conductive microfibers and the slidable contact surface on the counterpart side. Therefore, rotational loss caused by the conductive fiber brush can be eliminated, thereby to contribute to the size reduction of the electric motor.

According to the invention of the second aspect, the conductive fiber brush is arranged between a peripheral surface of the journaling case part of the anticathode accommodating case and a peripheral surface of the shaft part of the rotary anticathode, with both peripheral surfaces being opposed to each other. Accordingly, the conductive fiber brush can be incorporated without causing a problem in terms of a space.

According to the invention of the third aspect, the conductive fiber brush includes: a conductive ring fitted into an inner periphery of the journaling case part; and a large number of the conductive microfibers, each base end thereof being supported by an inner periphery of the conductive ring in a brush-like shape and each distal end thereof being in soft contact with an outer periphery of the shaft part of the rotary anticathode. Therefore, the conductive fiber brush can be easily incorporated between the rotary anticathode and the anticathode accommodating case.

According to the invention of the fourth aspect, the conductive fiber brush includes: a conductive ring fitted into an outer periphery of the shaft part of the rotary anticathode; and a large number of the conductive microfibers, each base end thereof being supported by an outer periphery of the conductive ring in a brush-like shape and each distal end thereof being in soft contact with an inner periphery of the journaling case part. Accordingly, the conductive fiber brush can be easily incorporated between the rotary anticathode and the anticathode accommodating case.

According to the invention of the fifth aspect, the conductive fiber brush includes: a pair of conductive rings which are provided respectively on an outer periphery of the shaft part of the rotary anticathode and on an inner periphery of the journaling case part, with mutual end surfaces opposed to each other in the axial direction; and a large number of the conductive microfibers, each base end thereof being supported by the opposed end surface of one of the pair of conductive rings in a brush-like shape, and each distal end thereof being in soft contact with the opposed end surface of the other conductive ring. Accordingly, the conductive fiber brush can be easily incorporated between the rotary anticathode and the anticathode accommodating case.

According to the invention of the sixth aspect, pure water or ion-exchange water having low electric conductivity is used as cooling water flown through the water-cooled jacket. Therefore, it is possible to prevent oxides from being generated in the cooling water more reliably.

DETAILED DESCRIPTION OF THE PREFERRED EMBODIMENTS

Embodiments of an X-ray generator according to the present invention will now be described with reference to drawings.

Figure 1:
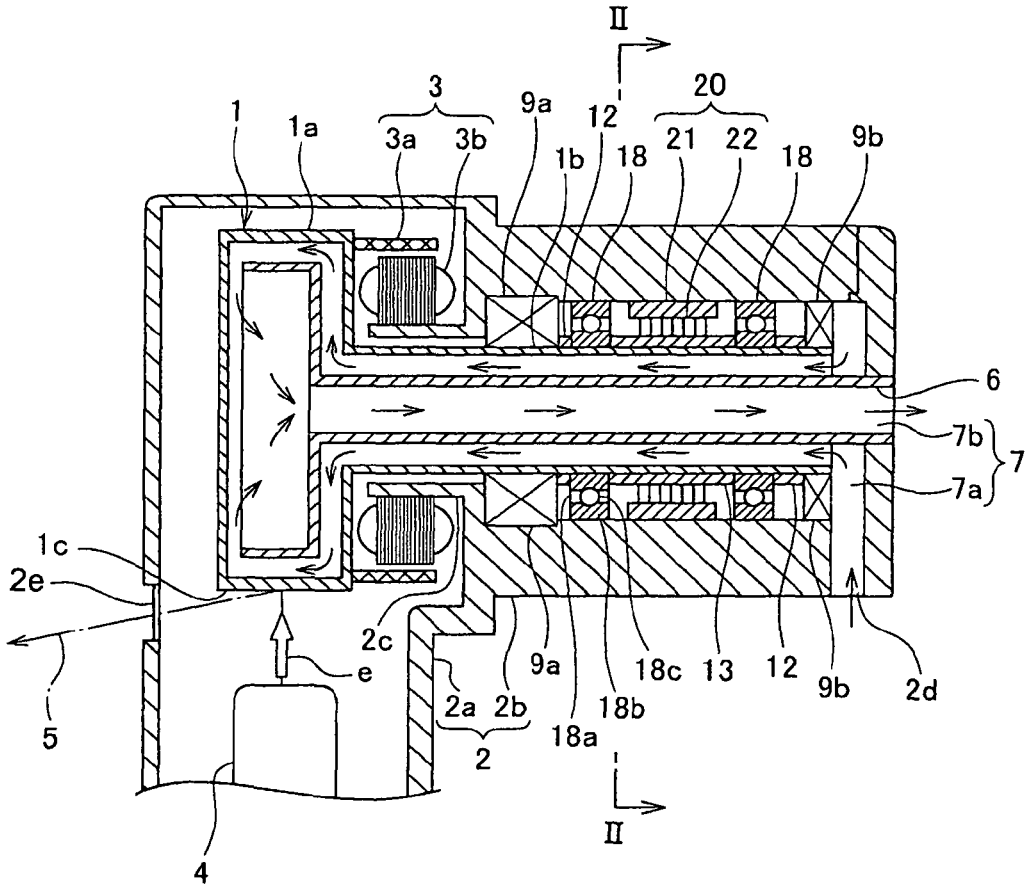
FIG. 1 is a sectional view of a structure of an X-ray generator according to an embodiment of the present invention.
Figure 2:
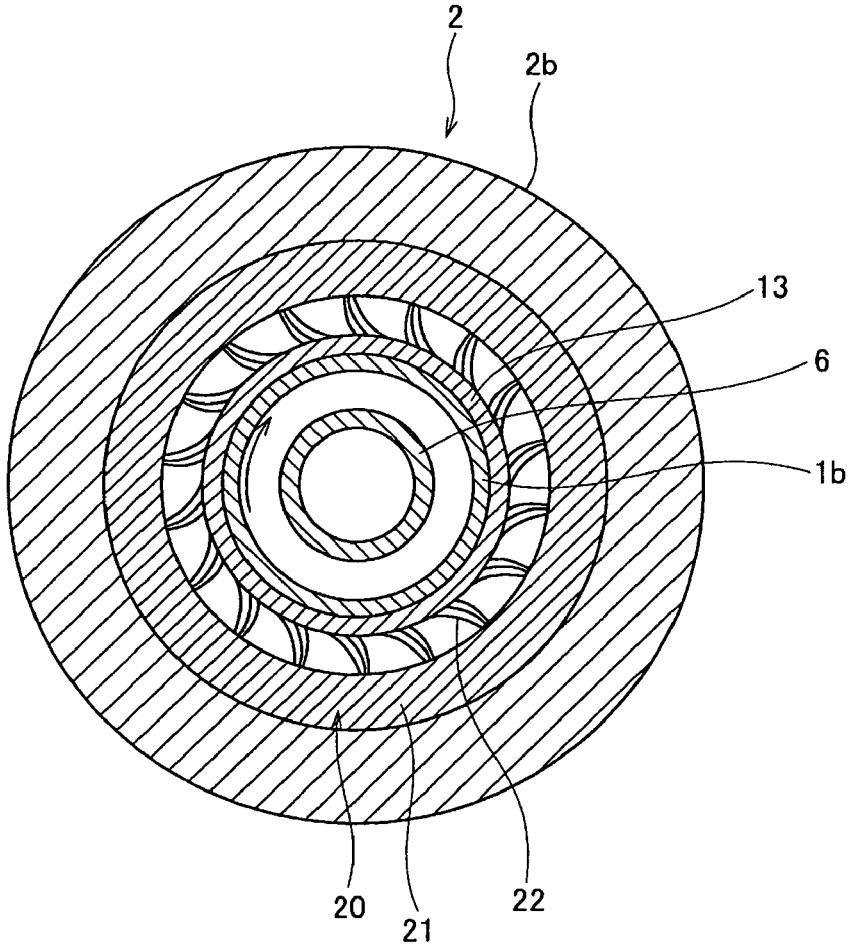
FIG. 2 is a sectional view in the direction of the arrow II-II in FIG. 1.

FIG. 1 is a sectional view of an X-ray generator according to an embodiment, and FIG. 2 is a sectional view in the direction of the arrow II-II in FIG. 1.

Figure 5:
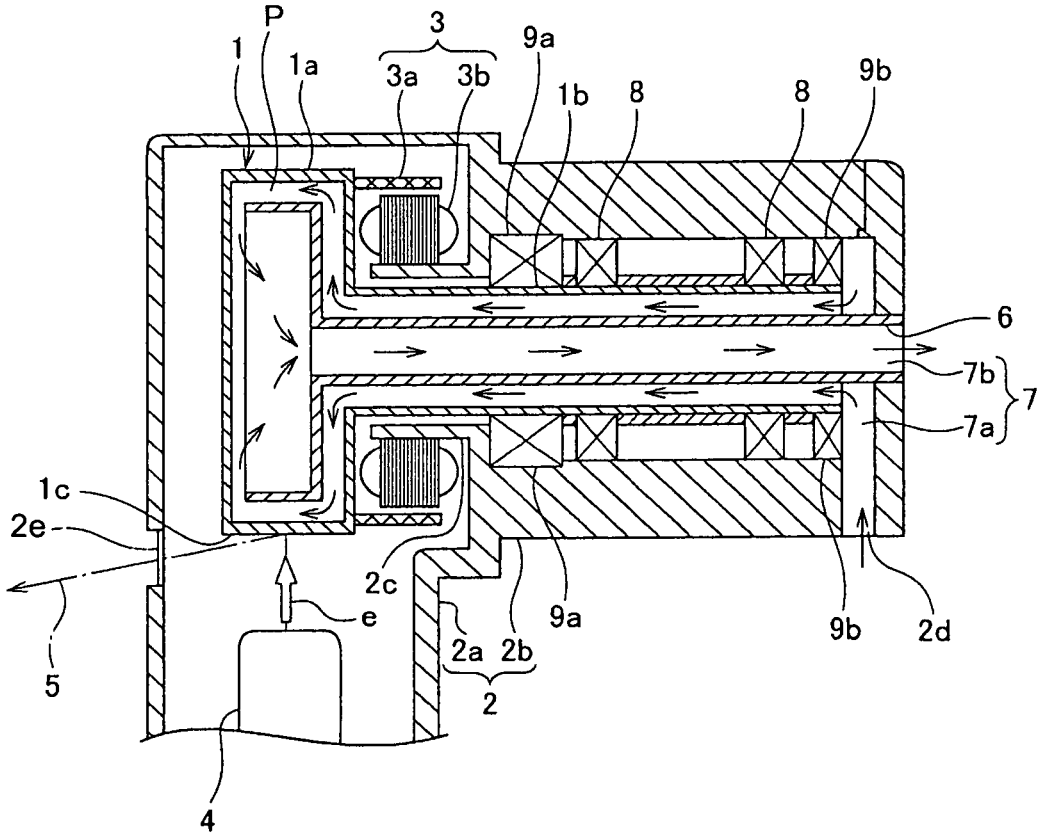
FIG.5 PRIOR ART
FIG. 5 is a sectional view of a structure of a conventional X-ray generator.

The X-ray generator according to the present embodiment shown in FIGS. 1 and 2 differs from a conventional X-ray generator shown in FIG. 5 in the following three points. Since the other of the structure is the same as that of the X-ray generator shown in FIG. 5, the same reference numeral is used to denote the same element, and further description thereof will be omitted.

(1) A conductive fiber brush 20 having a large number of conductive microfibers 22 serving as slide-contacting brush is arranged between a peripheral surface of a journaling case part 2*b* of an anticathode accommodating case 2 and a peripheral surface of a shaft part 1*b* of a rotary anticathode 1, such that current is flown from the rotary anticathode 1 to the anticathode accommodating case 2 via the conductive fiber brush 20.

(2) An insulating bearing 18 in which at least one of an inner ring 18*a*, an outer ring 18*b* or a rolling element (ball) 18*c* is made of an insulating material is used as a bearing for rotatively supporting the shaft part 1*b* of the rotary anticathode 1.

(3) Pure water or ion-exchange water having low electric conductivity is used as cooling water flown through a water-cooled jacket 7.

In this case, the insulating bearing 18 is positioned in the axial direction by sleeve-shaped spacers 12, 13 made of a conductive material fitted into the outer periphery of the shaft part 1*b* of the rotary anticathode 1, and distal ends of the conductive microfibers 22 of the conductive fiber brush 20 are in contact with the outer periphery of the sleeve-shaped spacer 13. As shown in FIG. 2, the conductive fiber brush 20 includes a conductive ring 21 and a large number of the conductive microfibers 22. The conductive ring 21 is fitted into the inner periphery of the journaling case part 2*b*. A base end of each conductive microfiber 22 is supported by the inner periphery of the conductive ring 21 in a brush-like shape, and a distal end thereof is in soft contact with the outer periphery of the spacer 13. In other words, the conductive microfibers 22 are provided on the fixed side in the present embodiment.

Each conductive microfiber 22 is conductive fine filament made by, for example, bonding several micron-sized ultra-microfiber made by carbonizing acrylic fiber with copper sulfide. The filament is longer than the clearance between the outer periphery of the spacer 13 and the inner periphery of the conductive ring 21. Therefore, when the shaft part 1*b* of the rotary anticathode 1 and the spacer 13 are integrally rotated, the distal ends of the conductive microfibers 22, while being urged along the rotational direction of the spacer 13, slide with the outer periphery of the spacer 13 as if the distal ends were stroking the outer periphery.

A ceramic bearing in which ceramic balls are incorporated as the rolling element 18 is preferably used as the insulating bearing 20.

Such configuration as described above provides the following effects.

That is, the conductive fiber brush 20 having a large number of the conductive microfibers 22 serving as slide-contacting brush is arranged between the peripheral surface of the journaling case part 2*b* and the peripheral surface of the shaft part 1*b* of the rotary anticathode 1, with both peripheral surfaces being opposed to each other, such that current is flown from the rotary anticathode 1 to the anticathode accommodating case 2 via the conductive fiber brush 20 of a conductive microfiber type. Accordingly, unlike the conventional case where a contact piece is made in slidable contact with the outer periphery of the shaft part by means of a force of a spring, the distal ends of the conductive microfibers 22 serving as slide-contacting brush can be in slidable contact with the outer periphery of the spacer 13 fitted into the shaft part 1*b*, in the state where substantially no pressure is applied thereto. Therefore, since no contact pressure is applied, the conductive microfibers 22 are free from wear, and current in the rotary anticathode 1 can escape to the anticathode accommodating case 2 reliably over long periods. In addition, the insulating bearing 18 is employed as the bearing for rotatively supporting the rotary anticathode 1. Therefore, let alone a problem of electric corrosion of the bearing, a problem of decreased cooling efficiency caused by oxides generated in cooling water because of electric corrosion can be effectively resolved.

In addition, the conductive microfibers 22 of the conductive fiber brush 20 are substantially free from wear, and there is no risk of temperature increase due to frictional heat. Therefore, the conductive microfibers 22 are compatible with the substantially increased rotational speed of the rotary anticathode 1, thereby to enable increasing output and brightness of X-ray. Furthermore, there is neither risk of abrasion powders being generated from the conductive fiber brush 20, nor risk of temperature increase due to frictional heat. Therefore, such a problem that temperature increase or generation of abrasion powders would negatively affect seals 9*a*, 9*b*, the bearing 18, or the like will not occur. In addition, substantially no frictional resistance is generated between the distal ends of the conductive microfibers 22 and the sleeve 13 on the outer periphery of the shaft part 1*b*. Therefore, rotational loss caused by the conductive fiber brush 20 can be eliminated, thereby to contribute to the size reduction of the electric motor 3.

In addition, in the present embodiment, the conductive fiber brush 20 includes the conductive ring 21 and a large number of the conductive microfibers 22. The conductive ring 21 is fitted into the inner periphery of the journaling case part 2*b*. The base end of each conductive microfiber 22 is supported by the inner periphery of the conductive ring 21 in a brush-like shape, and the distal end thereof is in soft contact with the outer periphery of the spacer 13. Therefore, the conductive fiber brush 20 can be easily incorporated between the rotary anticathode 1 and the anticathode accommodating case 2.

In addition, since pure water or ion-exchange water having low electric conductivity is used as cooling water flown through the water-cooled jacket 7, it is possible to prevent oxides from being generated in the cooling water more reliably. Therefore, there is no risk of decreased cooling efficiency due to oxides, whereby stable performance can be assured.

Figure 3:
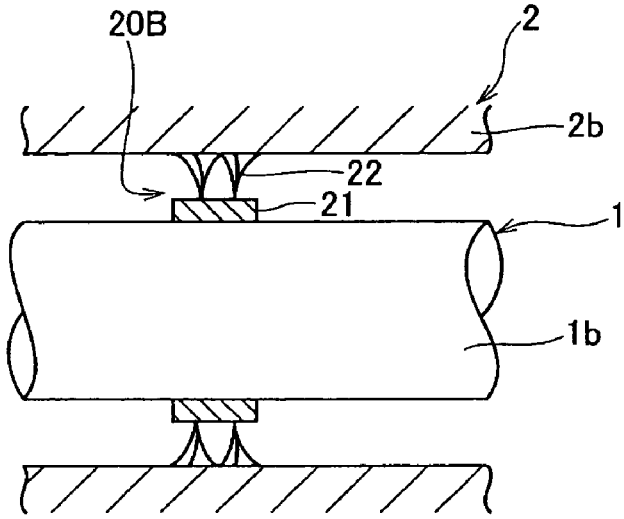
FIG. 3 is a sectional view of a major portion of another embodiment of the present invention.

Note that, the above-described embodiment has described the case where the conductive microfibers 22 of the conductive fiber brush 20 are attached to the anticathode accommodating case 2 side, which is the fixed side. That is, it shows the case where the conductive fiber brush 20 includes: the conductive ring 21 fitted into the inner periphery of the journaling case part 2*b*; and a large number of the conductive microfibers 22, with each base end thereof being supported by the inner periphery of the conductive ring 21 in a brush-like shape, and each distal end thereof being in soft contact with the outer periphery of the shaft part 1*b* of the rotary anticathode 1 (the outer periphery of the sleeve 13). Instead, like a conductive fiber brush 20B according to an embodiment in FIG. 3, the conductive microfibers 22 may be attached to the rotation side. In this case, the conductive fiber brush 20B includes: the conductive ring 21 fitted into the outer periphery of the shaft part 1*b* of the rotary anticathode 1; and a large number of the conductive microfibers 22, with each base end thereof being supported by the outer periphery of the conductive ring 21 in a brush-like shape, and each distal end thereof being in soft contact with the inner periphery of the journaling case part 2*b*.

Figure 4:
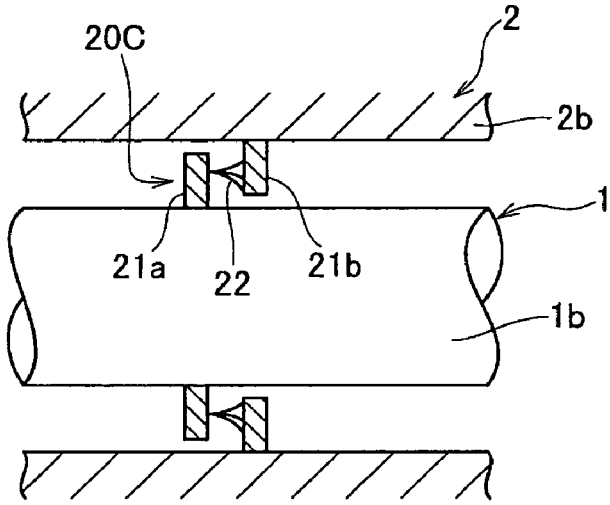
FIG. 4 is a sectional view of a major portion of yet another embodiment of the present invention.

Alternatively, a conductive fiber brush 20C shown in FIG. 4 may be employed. The conductive fiber brush 20C includes a pair of conductive rings 21*a*, 21*b*, and a large number of the conductive microfibers 22. The conductive rings 21*a*, 21*b* are provided on the outer periphery of the shaft part 1*b* of the rotary anticathode 1 and on the inner periphery of the journaling case part 2*b*, respectively. End surfaces of the conductive ring 21*a* and of the conductive ring 21*b* are opposed with other in the axial direction. A base end of each conductive microfiber 22 is supported, in a brush-like shape, by the opposed end surface of one conductive ring 21*a* of the pair of conductive rings 21*a*, 21*b*, and a distal end thereof is in soft contact with the opposed end surface of the other conductive ring 21*b*. Alternatively, the conductive microfibers 22 may be configured such that each base end thereof is attached to the opposed end surface of the conductive ring 21*b* on the fixed side, and each distal end thereof is in slidable contact with the opposed end surface of the conductive ring 21*a* on the rotation side.

Any configuration of the conductive microfibers 22 is acceptable as long as the distal ends of a large number of the conductive microfibers 22, with the base ends thereof being fixed to the conductive ring, are in contact with the slidable contact surface of the counterpart side as if the base ends are stroking the contact surface.

What is claimed is:

1. An X-ray generator comprising:

a rotary anticathode having an anticathode part to generate an X-ray by collision of thermal electrons, and a shaft part provided coaxially with the rotary anticathode part;

an anticathode accommodating case having an air-tight case for maintaining a periphery of the anticathode part to a vacuum atmosphere, and a journaling case part for rotatably supporting the shaft part via a bearing;

an electric motor that rotatingly drives the rotary anticathode, and a cooled jacket through which a cooling water is flown for cooling the anticathode part and the shaft part, provided inside of the rotary anticathode, wherein an insulating bearing is used as the bearing, with at least one of an inner ring, an outer ring, and a rolling element of the insulating bearing being made of an insulating material, a conductive fiber brush, having a plurality of conductive microfibers serving as a slide-contacting brush, is arranged between the anticathode accommodating case and the rotary anticathode, so that current is flown from the rotary anticathode to the anticathode accommodating case via the conductive fiber brush, and each of the conductive microfibers is formed of a conductive fine filament made by bonding a plurality of micron-sized microfibers made by carbonizing an acrylic fiber with copper sulfide.

2. The X-ray generator according to claim 1, wherein the conductive fiber brush is arranged between opposing peripheral surfaces of the journaling case part of the anticathode accommodating case and the shaft part of the rotary anticathode.

3. The X-ray generator according to claim 2, wherein pure water or ion-exchange water having low electric conductivity is used as the cooling water flown through the water-cooled jacket.

4. The X-ray generator according to claim 1, wherein the conductive fiber brush comprises: a conductive ring fitted into an inner periphery of the journaling case part; and each of the conductive microfibers having a base end being supported by an inner periphery of the conductive ring in a brush-like shape and a distal end being in soft contact with an outer periphery of the shaft part of the rotary anticathode.

5. The X-ray generator according to claim 4, wherein pure water or ion-exchange water having low electric conductivity is used as the cooling water flown through the water-cooled jacket.

6. The X-ray generator according to claim 1, wherein the conductive fiber brush comprises: a conductive ring fitted into an outer periphery of the shaft part of the rotary anticathode; and each of the conductive microfibers having a base end being supported by an outer periphery of the conductive ring in a brush-like shape and a distal end being in soft contact with an inner periphery of the journaling case part.

7. The X-ray generator according to claim 6, wherein pure water or ion-exchange water having low electric conductivity is used as the cooling water flown through the water-cooled jacket.

8. The X-ray generator according to claim 1, wherein the conductive fiber brush comprises: a pair of conductive rings which are provided respectively on an outer periphery of the shaft part of the rotary anticathode and on an inner periphery of the journaling case part, with mutual end surfaces opposed to each other in an axial direction of the shaft part of the rotary anticathode; and each of the conductive microfibers extending in the axial direction of the shaft part of the rotary anticathode and having a base end being supported by an opposed end surface of one of the pair of conductive rings in a brush-like shape, and a distal end being in soft contact with the opposed end surface of the other conductive ring.

9. The X-ray generator according to claim 8, wherein pure water or ion-exchange water having low electric conductivity is used as the cooling water flown through the water-cooled jacket.

10. The X-ray generator according to claim 8, wherein a first conductive ring of the pair of conductive rings is attached to the inner periphery of the journaling case part and a second conductive ring of the pair of conductive rings is attached to the outer periphery of the shaft part of the rotary anticathode, wherein each base end of the conductive microfibers is attached to the opposed end surface of the first conductive ring, and each distal end of the conductive microfibers is in slidable contact with the opposed end surface of the second conductive ring.

11. The X-ray generator according to claim 1, wherein pure water or ion-exchange water having low electric conductivity is used as the cooling water flown through the water-cooled jacket.

* * * * *